US008809722B2

(12) United States Patent
Chen et al.

(10) Patent No.: US 8,809,722 B2
(45) Date of Patent: Aug. 19, 2014

(54) CIRCUIT BREAKER WITH TRANSLATING ELECTRICAL CONTACT, CIRCUIT BREAKER ELECTRICAL CONTACT ASSEMBLIES, AND OPERATIONAL METHODS

(71) Applicant: Siemens Industry, Inc., Alpharetta, GA (US)

(72) Inventors: Hai Chen, Duluth, GA (US); Hector Malacara, Norcross, GA (US); Justin Cyle Bennett, Atlanta, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 190 days.

(21) Appl. No.: 13/649,786

(22) Filed: Oct. 11, 2012

(65) Prior Publication Data

US 2014/0103013 A1 Apr. 17, 2014

(51) Int. Cl.
*H01H 9/34* (2006.01)

(52) U.S. Cl.
USPC ..... 218/154; 218/22; 335/16; 335/35; 335/201

(58) Field of Classification Search
USPC ..... 218/22, 154–156; 335/16, 35, 201
See application file for complete search history.

(56) References Cited

U.S. PATENT DOCUMENTS

| | | | | |
|---|---|---|---|---|
| 4,001,743 | A * | 1/1977 | Arnhold | 335/201 |
| 4,945,325 | A * | 7/1990 | Toda et al. | 335/16 |
| 6,348,666 | B2 * | 2/2002 | Rival et al. | 218/156 |
| 6,774,751 | B2 * | 8/2004 | Bach et al. | 335/196 |
| 7,081,596 | B2 * | 7/2006 | Schneider et al. | 218/22 |
| 7,132,912 | B2 * | 11/2006 | Busenhart | 335/6 |
| 7,138,597 | B2 | 11/2006 | Miller | |
| 7,839,241 | B2 * | 11/2010 | Weber et al. | 335/35 |
| 8,093,984 | B2 * | 1/2012 | Hofmann et al. | 337/78 |
| 8,735,758 | B2 * | 5/2014 | Chen et al. | 218/154 |

* cited by examiner

*Primary Examiner* — Truc Nguyen

(57) ABSTRACT

Circuit breakers having an electrical contact assembly with a moving electrical contact that is linearly translatable within an inner cavity are disclosed. A guide linearly carries a moveable contact assembly having the moving electrical contact and the guide has one or more guide supports accessible by a drive member external to the cavity. According to another aspect, a circuit breaker electrical contact assembly and method of operating a circuit breaker is provided, as are other aspects.

22 Claims, 8 Drawing Sheets

FIG. 2A
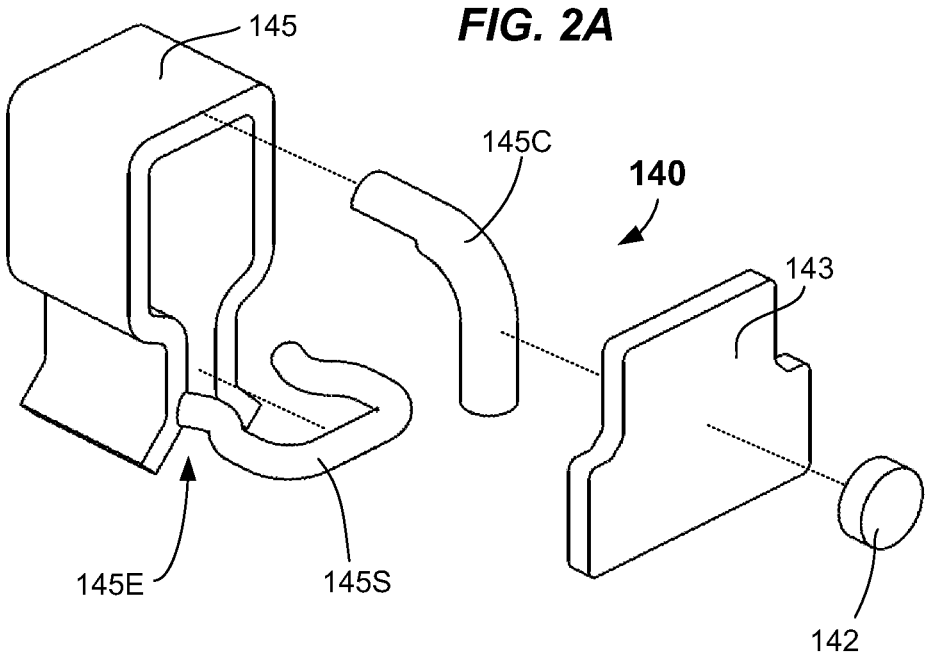
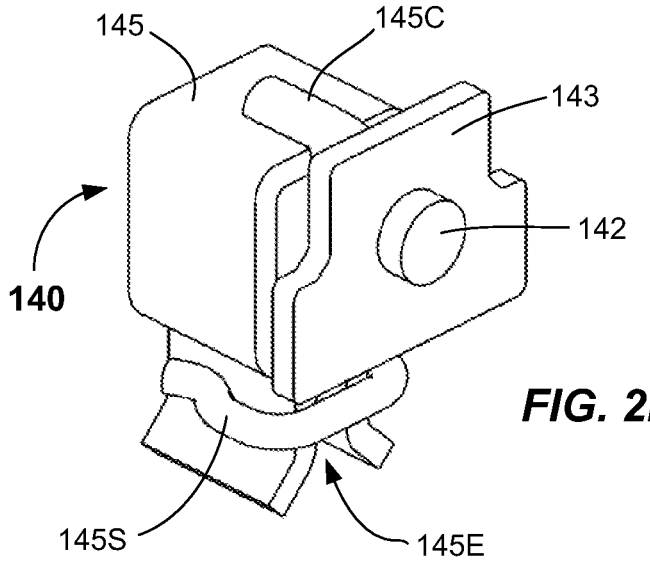
FIG. 2B

CIRCUIT BREAKER WITH TRANSLATING ELECTRICAL CONTACT, CIRCUIT BREAKER ELECTRICAL CONTACT ASSEMBLIES, AND OPERATIONAL METHODS

FIELD

The present invention relates generally to circuit breakers, and more particularly to separable electrical contact assemblies for circuit breakers.

BACKGROUND

In general, a circuit breaker operates to engage and disengage a selected electrical circuit from an electrical power supply. The circuit breaker ensures current interruption thereby providing protection to the electrical circuit from continuous over current conditions and high current transients due, for example, to electrical short circuits. Such circuit breakers operate by separating a pair of internal electrical contacts contained within a housing of the circuit breaker. Typically, one electrical contact is stationary while the other is movable. Conventional circuit breakers include a moving electrical contact mounted on an end of a pivotable contact arm, such that the moving electrical contact moves through an arc-shaped motion path. Contact separation between the moving and stationary contacts may occur manually, such as by a person throwing a handle of the circuit breaker. This may engage a trip mechanism, which may be coupled to the contact arm and the moveable contact. Otherwise, the electrical contacts may be separated automatically when an over current or short circuit condition is encountered. This automatic tripping may be accomplished by a tripping mechanism actuated via a thermal overload element (e.g., a bimetal element) or by an actuator element (e.g., an electromagnetic actuator).

Upon contact separation of the electrical contacts by tripping of the circuit breaker, a substantial electrical arc may be formed. It is desirable to extinguish such arc as quickly as possible to avoid damaging internal components of the circuit breaker. However, in previous circuit breakers, although extinguishment of such arcs has been effective, the arc may not have been extinguished as rapidly as desired. Furthermore, more rapid contact separation is desirable.

Accordingly, there is a need for circuit breaker apparatus, circuit breaker contact assemblies, and methods of operating circuit breakers that offer better arc extinguishment following electrical contact separation and/or to promote more rapid electrical contact separation.

SUMMARY

According to a first aspect, a circuit breaker is provided. The circuit breaker includes a circuit breaker housing and a circuit breaker electrical contact assembly within the circuit breaker housing having an arc chamber housing, the arc chamber housing having an inner cavity, a guide having a translating portion received within the inner cavity and one or more guide supports accessible from outside the inner cavity, the translating portion translatable in the inner cavity, and a drive member coupled to the one or more guide supports.

In accordance with another aspect, a circuit breaker electrical contact assembly is provided. The circuit breaker electrical contact assembly includes an arc chamber housing having an inner cavity, a guide having a translating portion positioned within the inner cavity and one or more guide supports accessible from outside the inner cavity, the translating portion translatable within the inner cavity, a moving electrical contact assembly coupled to the guide, and a drive member coupled to the one or more guide supports.

In accordance with another aspect, a method of operating a circuit breaker is provided. The method includes providing an arc chamber housing having an inner cavity, a guide having a translating portion positioned within the inner cavity and one or more guide supports outside the inner cavity, and a moving electrical contact assembly coupled to the translating portion, coupling a drive member to the one or more guide supports, and moving the drive member to translate the translatable portion within the inner cavity and move a moving electrical contact within the inner cavity.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the invention.

BRIEF DESCRIPTION OF DRAWINGS

FIG. 2A illustrates an exploded isometric view of a stationary contact assembly of a circuit breaker electrical contact assembly according to embodiments.

FIG. 2B illustrates an exploded isometric view of a stationary electrical contact assembly of a circuit breaker electrical contact assembly according to embodiments.

DETAILED DESCRIPTION

Figure 1A:
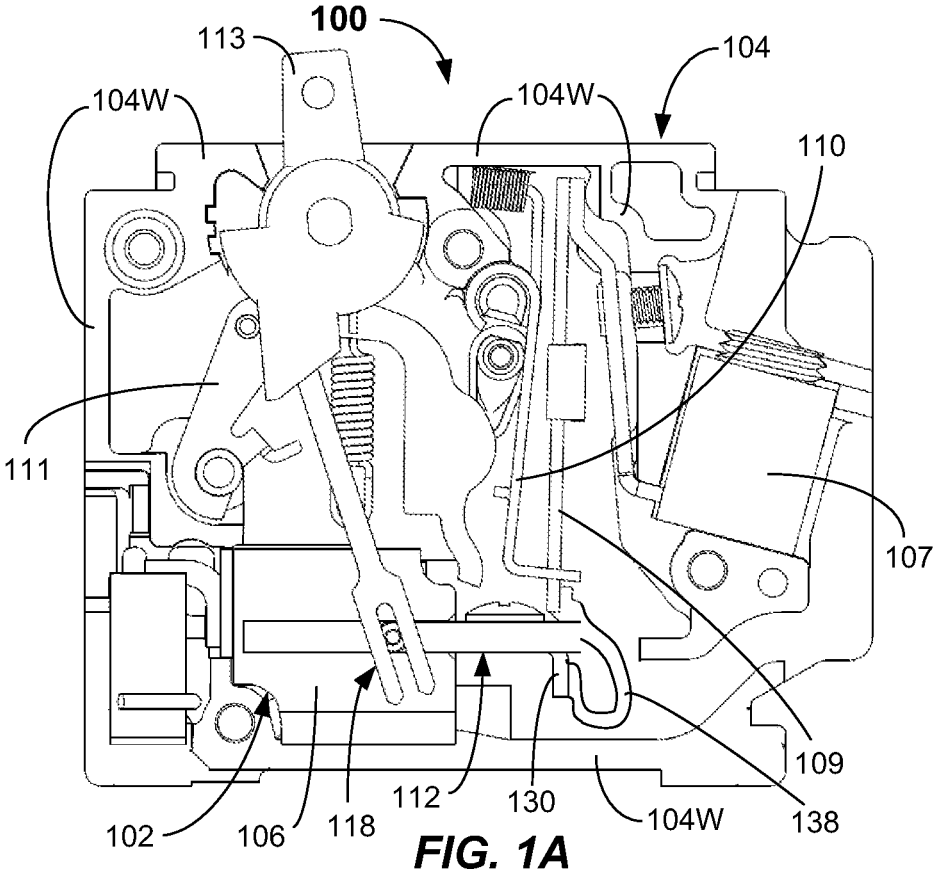
FIG. 1A illustrates a side plan view of a circuit breaker including a circuit breaker electrical contact assembly according to embodiments, shown in a NEUTRAL orientation.

In view of the foregoing difficulties in extinguishing the arc, there is a need to extinguish an electrical arc in such circuit breakers as soon as possible after electrical contact separation occurs. Such separation is due to circuit interruption following a circuit breaker tripping event. According to one or more embodiments of the invention, a circuit breaker including an improved circuit breaker electrical contact assembly is provided.

The circuit breaker includes an improved circuit breaker electrical contact assembly within the circuit breaker. The circuit breaker electrical contact assembly has an arc chamber housing having an inner cavity. A guide having a translating portion is received within the inner cavity and is linearly translatable therein. The guide carries the moveable contact and is provided within the inner cavity in a manner so as to provide a semi-sealed arc chamber.

During contact separation, the guide translates within the inner cavity and is driven open by an increase in pressure in the arc chamber via high temperatures produced therein. The semi-sealed nature of the arc chamber minimizes oxygen inside the arc chamber, which may prevent contact erosion. The arc is substantially contained within the arc chamber during the contact separation.

The guide includes one or more guide supports that are accessible from outside the inner cavity. In this way, the translating portion may be linearly translated within the inner cavity responsive to a drive member external to the inner cavity. The drive member may be coupled to the one or more guide supports and may be a fork in some embodiments.

The principles of the present invention are not limited to the illustrative examples depicted herein, but may be applied and utilized in any type of circuit breaker, either mechanical or electronic, such as single-pole circuit breakers, duplex circuit breakers, two-pole circuit breakers, multi-pole circuit breakers, ground fault circuit interrupters (GFCI), arc fault circuit interrupters (AFCI), surge protective devices (TVSS), metering circuit breakers, electronic trip unit breakers, or remotely-controllable circuit breakers.

These and other embodiments of the circuit breaker electrical contact assembly, circuit breakers containing the circuit breaker electrical contact assembly and methods of operating circuit breakers having the circuit breaker electrical contact assembly according to the present invention are described below with reference to FIGS. 1A-4. Like reference numerals used in the drawings identify similar or identical elements throughout the several views. The drawings are not necessarily drawn to scale.

Referring now to FIG. 1A-1J, various views of a circuit breaker 100 including the inventive circuit breaker electrical contact assembly 102 in accordance with embodiments of the invention are illustratively shown. Circuit breaker 100 includes a circuit breaker housing 104, which may be molded case housing made from a suitable plastic material, for example. The material may be a thermoset material, such as a glass-filled polyester, or a thermoplastic material such as a Nylon material (e.g., Nylon 6), for example. Other suitable housing materials may be used.

The circuit breaker housing 104 may be made up of any number of interconnecting housing sections (only one side section shown). For example, two halves may be connected together to form the housing 104 and internal cavity for receiving the inventive circuit breaker electrical contact assembly 102. The housing 104 may include an arrangement of internal and external walls 104W, which are adapted to contain or retain various components of the circuit breaker 100. In the depicted embodiment, the housing 104 includes a first and second side portions which interface, as conventional to form an internal pocket containing the breaker components. Conventional breaker components include load terminal 107, bimetal assembly 109, latch 110, and cradle 111, and handle 113 which are entirely conventional and will not be explained in further detail.

According to embodiments of the invention, the circuit breaker electrical contact assembly 102 includes an arc chamber housing 106 that is positioned within the circuit breaker housing 104. For example, the arc chamber housing 106 may be retained in a generally fixed orientation relative to the circuit breaker housing 104 by one or more retaining features, such as walls, pockets, juts, or projections that capture the arc chamber housing 106 and fixedly secure it in place.

The arc chamber housing 106 may be made of the same materials discussed above. Arc chamber housing 106 includes an inner cavity 108 (FIG. 1B) that is defined at least by the inner side walls (e.g., top 106T, side 106S, bottom 106B, and end 106E) of the arc chamber housing 106 as shown in FIG. 1B. The inner cavity 108 may be open at a first end 114A and closed at a second end 114B.

The circuit breaker electrical contact assembly 102 further includes a guide 112 having a translating portion 115 received within the inner cavity 108. Translating portion 115 is translatable in and configured and adapted to linearly translate within the inner cavity 108. Guide 112 includes one or more guide supports 116A, 116B. Guide supports 116A and 116B may be accessible from outside the inner cavity 108 and may be used to translate the translating portion 115 within the inner cavity 108. Guide supports 116A and 116B may couple to a body 117 of the guide 112 at a second end 119B opposite from the translating portion 115 at a first end 119A. The one or more guide supports 116A, 116B may be received in grooves 120A and 120B formed on one or both sides of the arc chamber housing 106, and may slide therein. Guide supports 116A and 116B may slide within grooves 120A, 120B formed on an outside surface of the arc chamber housing 106. The guide 112 may be a molded plastic component, made of a polyester material, for example.

Figure 1B:
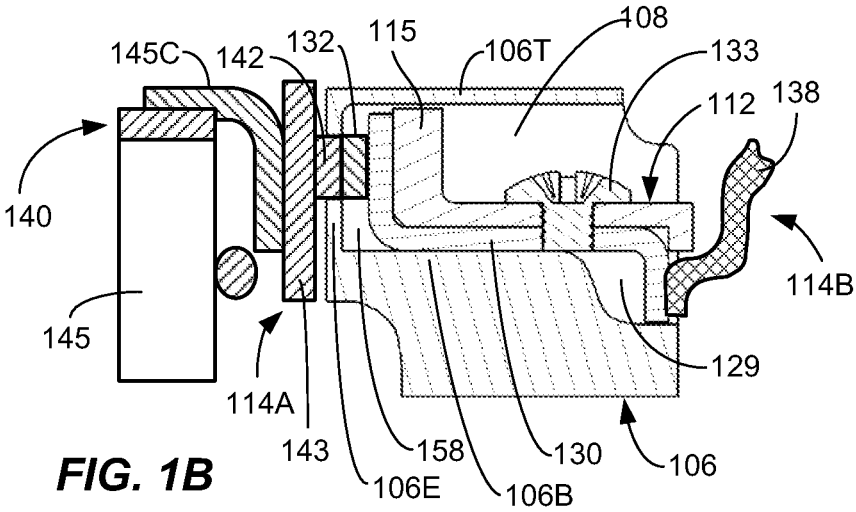
FIG. 1B illustrates a cross-sectioned side view of a portion of circuit breaker electrical contact assembly taken along section line 1B-1B of FIG. 1C according to embodiments.
Figure 1C:
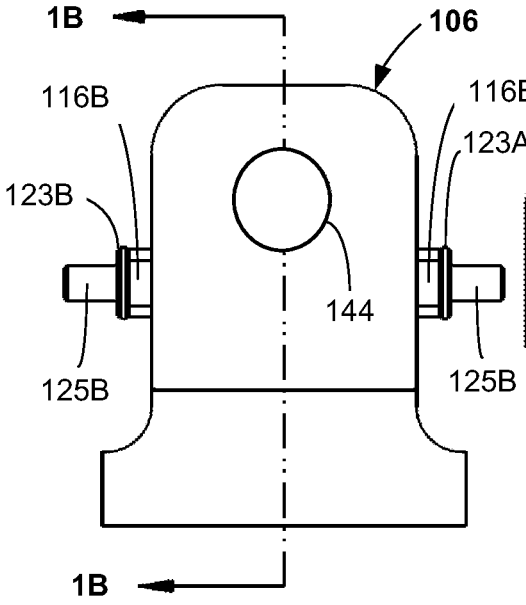
FIG. 1C illustrates an end plan view of a portion of a circuit breaker electrical contact assembly according to embodiments.
Figure 1D:
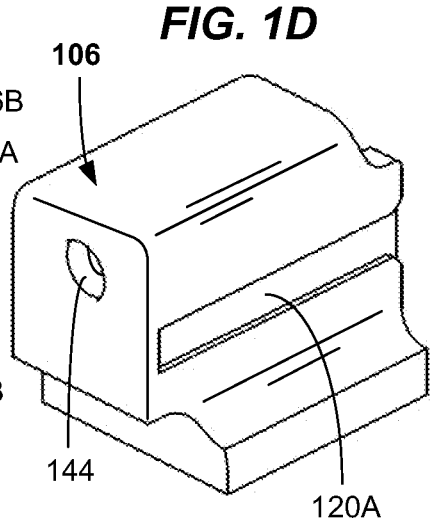
FIG. 1D illustrates an isometric view of a housing of a circuit breaker electrical contact assembly according to embodiments.
Figure 1E:
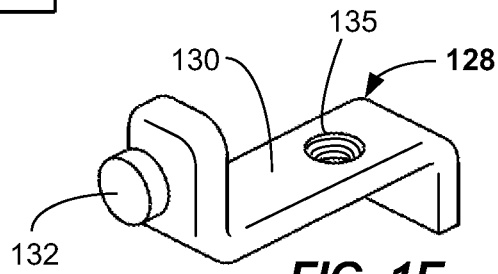
FIG. 1E illustrates an isometric view of a moveable contact assembly of a circuit breaker electrical contact assembly according to embodiments.
Figure 1F:
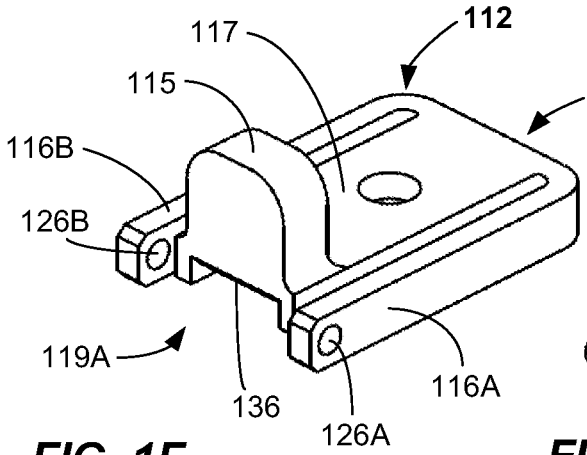
FIG. 1F illustrates an isometric view of a guide of a circuit breaker electrical contact assembly according to embodiments.
Figure 1G:
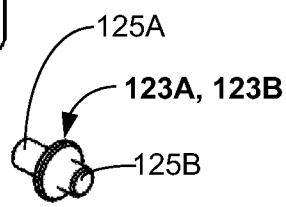
FIG. 1G illustrates an isometric view of a connector of a circuit breaker electrical contact assembly according to embodiments.
Figure 1H:
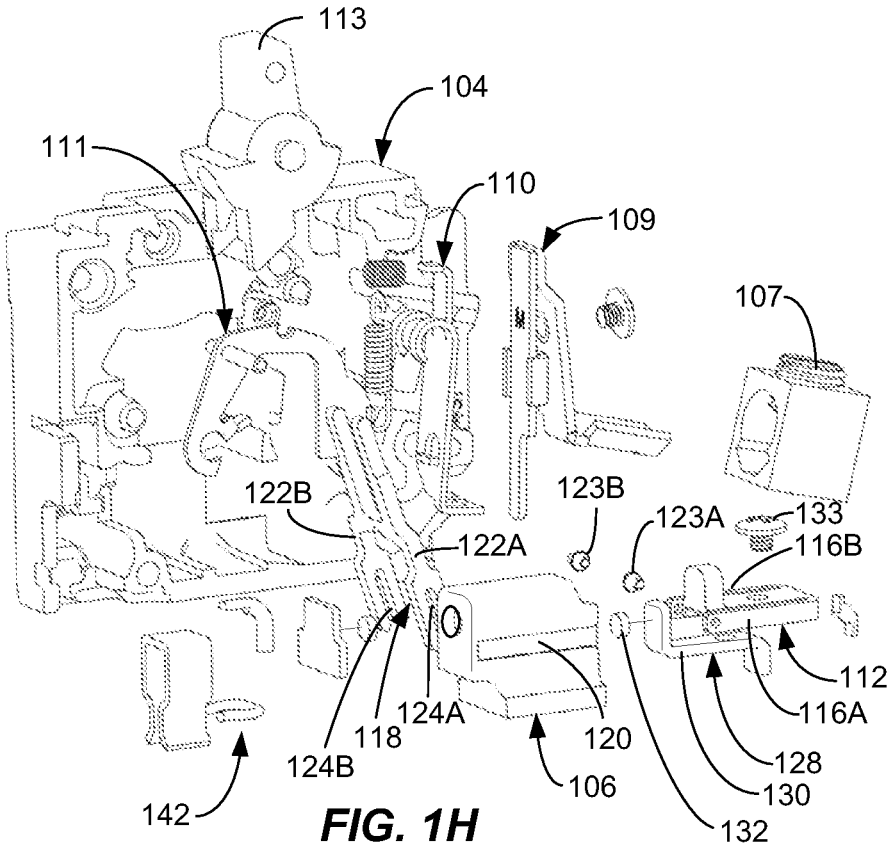
FIG. 1H illustrates an exploded isometric view of components of a circuit breaker including a circuit breaker electrical contact assembly according to embodiments.
Figure 1I:
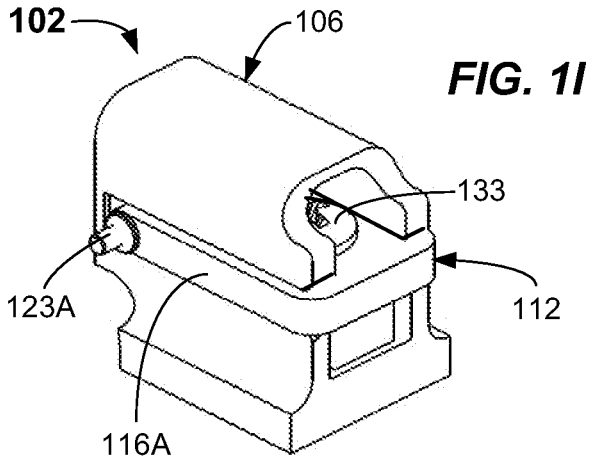
FIG. 1I illustrates an isometric view of a portion of a circuit breaker electrical contact assembly according to embodiments.

As shown in FIGS. 1A and 1H, the circuit breaker electrical contact assembly 102 includes a drive member 118. Drive member 118 is configured and adapted to couple to the guide 112. For example, the drive member 118 may be coupled to the one or more guide supports 116A, 116B. In one or more embodiments, the drive member 118 may comprise a fork having a first prong 122A received on a first side of the arc chamber housing 106 and a second prong 122B received on a second side of the arc chamber housing 106, so as to straddle the arc chamber housing 106. The drive member 118 may be coupled to the one or more guide supports 116A, 116B by connector pins 123A, 123B (FIG. 1G) being received on slots 124A, 124B formed on the prongs 122A, 122B thus coupling the first prong 122A to the first guide support 116A and coupling the second prong 122B to the second guide support 116B. The first and second connector pins 123A, 123B couple to the first and second guide supports 116A, 116B, respectively, by having first pilots 125A received in holes 126 on the first and second guide supports 116A, 116B. Pins 123A and 123B may be identical. A second pilot 125B may be received in the slots 124A, 124B of the drive member 118. Accordingly, rotation of the drove member 118 causes translation of the guide 112. Drive member 118 may be steel, plastic or other suitably rigid material.

In another aspect, a moving electrical contact assembly 128 may be coupled to the translating portion 115. For example, moving electrical contact assembly 128 may include a moving electrical contact 132 attached and secured to a conductor strap 130. Contact 132 may be welded or braised to conductor strap 130. Conductor strap 130 may be an electrically conductive material such as copper or copper alloy. Moving electrical contact assembly 128 may be coupled to the translating portion 115, such as by securing a fastener 133 through the body 117 and threading the fastener 133 into a threaded hole 135 of the conductor strap 130. The conductor strap 130 may extend along a length of the guide 112 (e.g., along the body 117) and may be received in a channel 136 thereof (FIG. 1F). Attached to an end of the conductor strap 130 opposite the moving electrical contact 132 may be a flexible conductor 138. Flexible conductor 138 may be any suitable electrically conductive material, such as a braided conductive strand of a copper and copper alloy material. The flexible conductor 138 may be attached to the conductive strap 130 by braising or the like.

In another aspect, the circuit breaker electrical contact assembly 102 may further include a stationary electrical contact assembly 140 as shown in FIGS. 2A and 2B. The stationary electrical contact assembly 140 has a stationary electrical contact 142 which may be positioned within a port 144 formed in the arc chamber housing 106 at an end of the inner cavity 108. The stationary electrical contact 142 may be relatively tightly received or even sealed in the port 144. The stationary electrical contact 142 may be coupled (e.g., by welding or braising) to a backing member 143. Backing member 143 may be electrically connected to a clip 145 by a stationary conductor 145C, which may be welded or braised to both the clip 145 and the backing member 143. End 145E of the clip 145 is adapted to clip onto and electrically connect to a stab or other conductor on a line terminal of a panelboard, for example. The connection force provided by the clip 145 may be supplemented by a clip spring 145S.

Figure 1J:
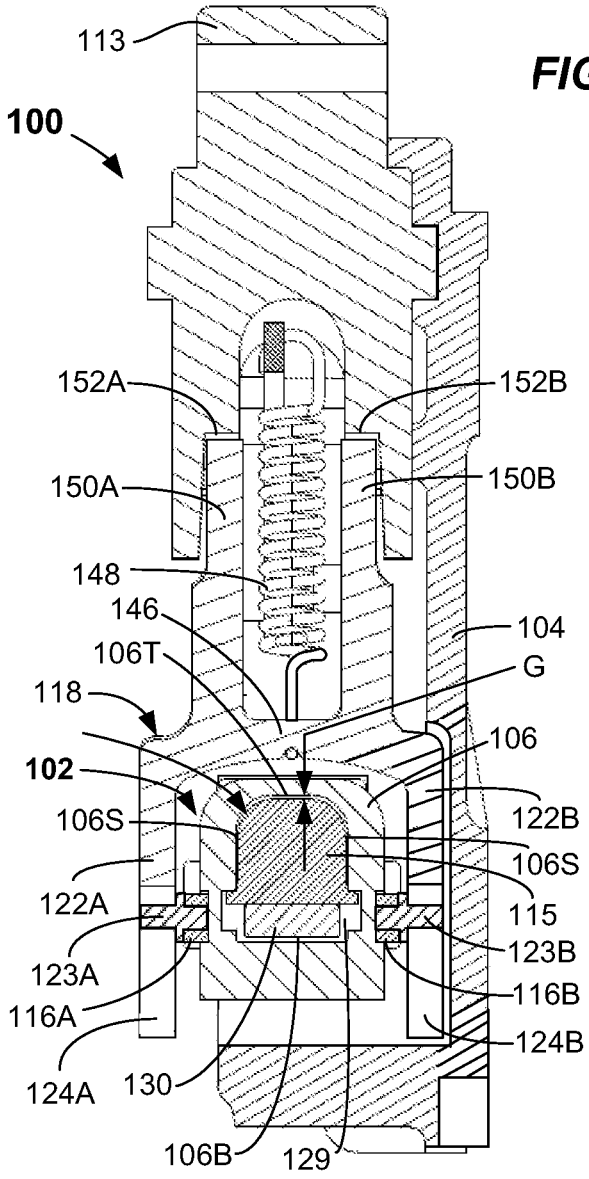
FIG. 1J illustrates a partial cross-sectioned end view of a circuit breaker having a circuit breaker electrical contact assembly taken along section line 1J-1J of FIG. 3A according to embodiments.

Referring now to FIG. 1J, a partial cross-sectioned end view of a circuit breaker 100 showing a portion of the circuit breaker housing 104 and a cross section of the circuit breaker electrical contact assembly 102 is shown. In particular, the drive member 118 (e.g., fork) comprises a bridge portion 146 spanning and coupling between the first and second prongs 122A, 122B, and a spring 148 (e.g., a coil spring) coupled to the bridge portion 144. The drive member 118 may comprise a first upright 150A and a second upright 150B, which may be co-parallel. First upright 150A and second upright 150B may be received within pockets 152A, 152B formed in the handle 113. The drive member 118, in the depicted embodiment, comprises a fork having a first prong 122A with a first slot 124A coupled to a first guide support 116A by a first connector pin 123A, and a second prong 122B with a second slot 124B coupled to a second guide support 116B by a second connector pin 123B. The first and second connector pins 123A, 123B slide in first and second slot 124A, 124B responsive to rotation of the drive member 118. Motion of the drive member 118 causes the guide 112 to linearly translate within the inner cavity 108. Any suitable sliding connector may be used.

Figure 3A:
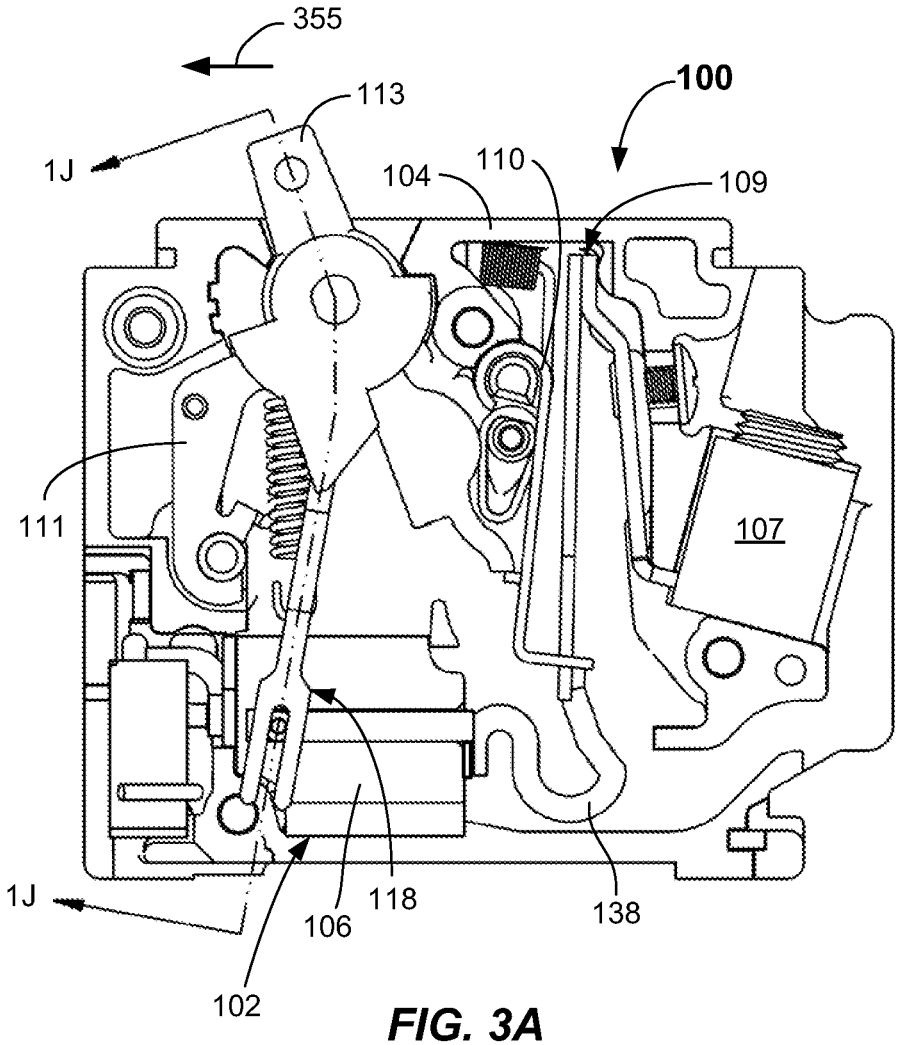
FIG. 3A illustrates a side plan view of the circuit breaker including the circuit breaker electrical contact assembly shown in an ON configuration according to embodiments.
Figure 3B:
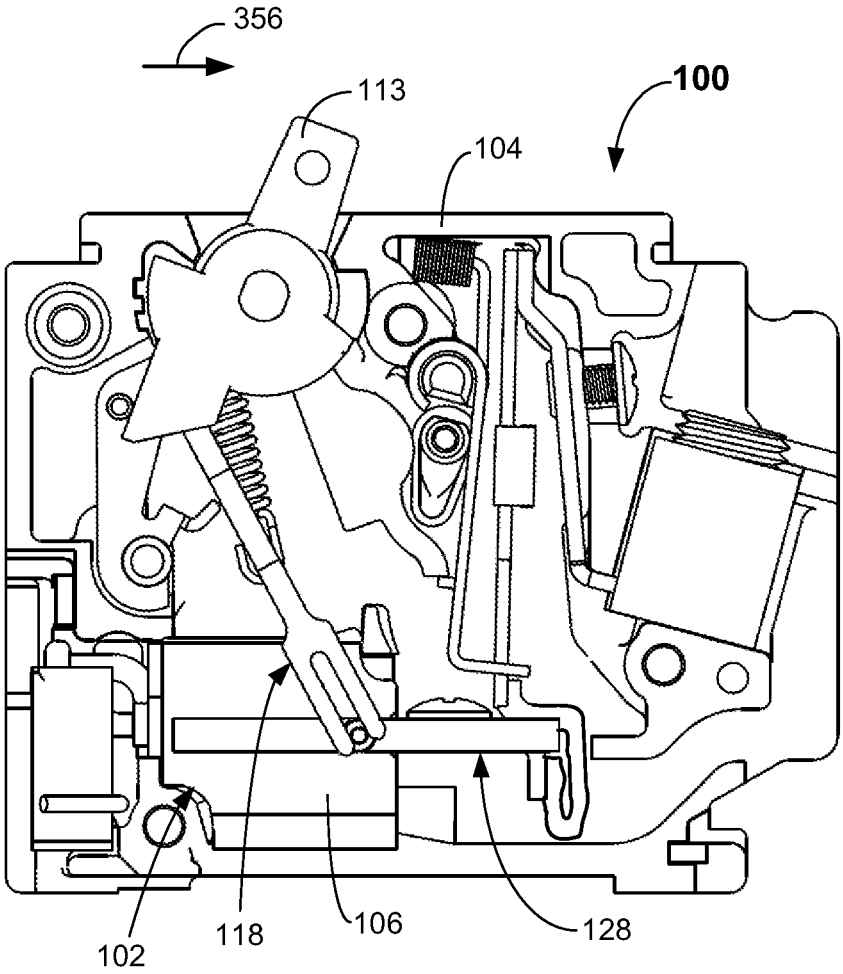
FIG. 3B illustrates a side plan view of the circuit breaker including a circuit breaker electrical contact assembly shown in an OFF configuration according to embodiments.

As shown in FIGS. 3A and 3B, rotation of the handle 113 causes the drive member 118 (e.g., fork) to rotate and move (e.g., linearly translate) the guide 112 and attached moveable electrical contact assembly 128. Movement in direction 355 in FIG. 3A moves the attached moveable electrical contact assembly 128 so that the electrical contacts are engaged (an "ON" configuration). Motion of the handle 113 in the direction 356 as shown in FIG. 3B moves the attached moveable electrical contact assembly 128 so that the electrical contacts are separated (an "OFF" configuration). In each case, the motion of the guide 112 and the attached moveable electrical contact assembly 128 is linear within the arc chamber housing 106, whereas the motion of the drive member 118 is rotational. In particular, the translating portion 115 is configured to linearly translate within the inner cavity 108. The translating portion 115, which may be located on an innermost portion of the guide 112, may include a shape that closely matches a cross-sectional shape of the inner cavity 108 along a portion of its length with minimal clearance as shown in FIGS. 1B and 1J. For example, a radial gap G (FIG. 1J) between the translating portion 115 and walls 106T, 106S, 106B of the inner cavity 108 may be less than about 0.40 mm or even less than about 0.25 mm, in some embodiments. The gap G may be range between about 0.15 mm and 0.40 mm in some embodiments, for example. This minimal gap G provides a semi-sealed arc chamber 158. Other gap values may be used.

Likewise, the radially outer surfaces of the conductor strap 130 and the side walls 106S and bottom wall 106B may include a radial gap of less than about 0.40 mm or even less than about 0.25 mm to form the semi-sealed arc chamber 158. The semi-sealing allows the gases generated during arcing to assist in rapid electrical contact separation by pushing on the translating portion 115.

At a portion of the linear stroke after separation of the moving and stationary electrical contacts 132, 142 has occurred (e.g., after about 16.5 mm of linear stroke or at about 80% of the full stroke to a fully opened configuration), a region of relatively larger cross-sectional area 129 in the inner cavity 108 may be accessed to provide rapid venting of arc gases and debris. This area of enlarged cross-sectional area 129 is adapted to provide venting as the guide 112 moves to an opened configuration after the contact separation. The enlarged area 129 may be provided underneath the guide 112 as shown, and around the conductor strap 130. The enlarged area 129 may enlarge the area by about 20% or more, for example, as compared to the area of the arc chamber 158 provided at the initial portion of the stroke following contact separation. Further conventional venting may allow the gases and debris that have escaped from the arc chamber housing 106 to escape the housing 104. Other configurations of the venting may be provided.

According to aspects of the invention, a time for extinguishing an arc generated by electrical contact separation during a circuit breaker tripping event may be shortened or minimized. This improvement in arc extinguishment may be accomplished in one aspect by using the pressures generated due to arcing to aid in moving the guide 112 and the attached electrical contact assembly 128. Additionally, the semi-sealed nature of the arc chamber 158 may restrict an amount of oxygen present and thus may reduce erosion of both the moving electrical contact 132 and stationary contact 142. Moreover, the semi-sealed nature of the arc chamber 158 protects portions of the electrical contact assembly 128 from contact with the arc which may reduce erosion.

In another aspect, a cross-sectional area of the arc chamber 158 in a transverse direction may be made relatively small.

This will effectively constrain or compress the electrical arc formed between the electrical contacts 132, 142. This may lead to relatively quicker arc extinguishment. The cross-sectional area of the arc chamber 158 may be about 70 $mm^2$ or less. Other cross-sectional values may be used. In some embodiments, a relatively small cross-sectional area of the arc chamber 158 of about 70 $mm^2$ or less may be combined with a semi-sealed arc chamber configuration with a gap G being less than about 0.4 mm.

Figure 4:
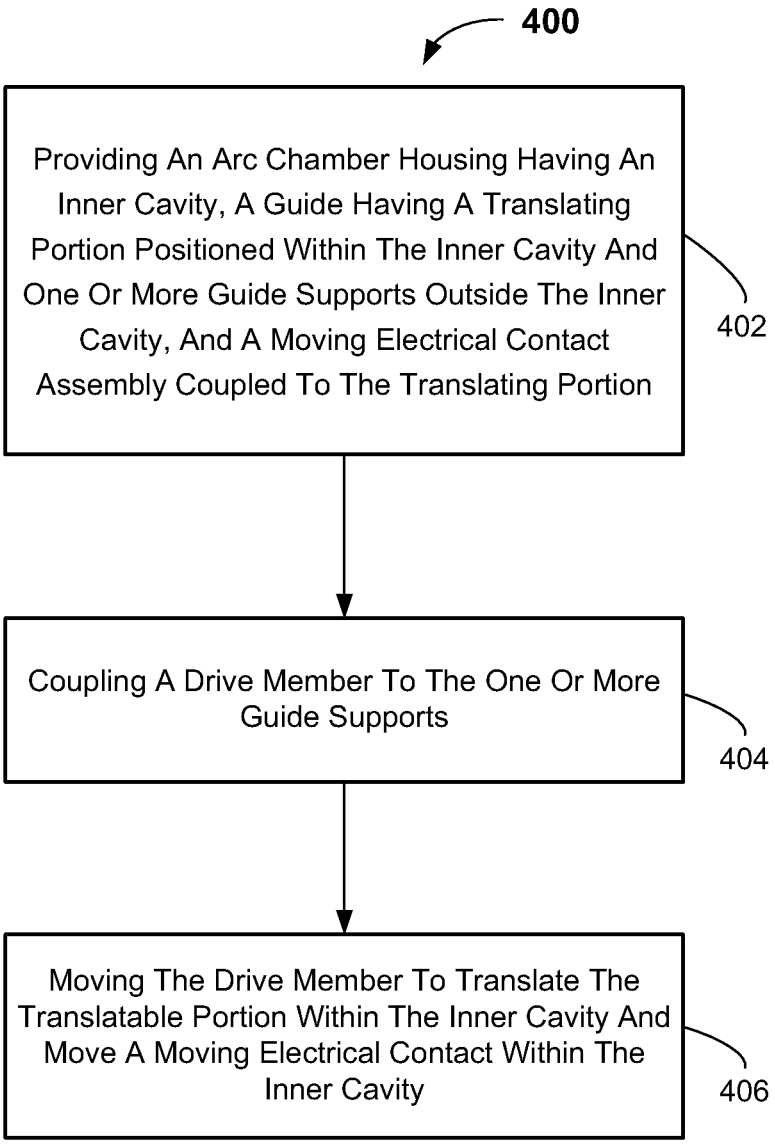
FIG. 4 illustrates a flowchart of a method of operating a circuit breaker according to embodiments.

According to another aspect, a method of operating a circuit breaker is provided. As shown in FIG. 4, the method 400 includes, in 402, providing an arc chamber housing (e.g., arc chamber housing 106) having an inner cavity (e.g., inner cavity 108), a guide (e.g., guide 112) having a translating portion (e.g., translating portion 115) positioned within the inner cavity and one or more guide supports (e.g., guide supports 116A, 116B) outside the inner cavity, and a moving electrical contact assembly (e.g., moving electrical contact assembly 128) coupled to the translating portion. The method 400 also includes, in 404, coupling a drive member (e.g., drive member 118) to the one or more guide supports, and, in 406, moving the drive member to translate (e.g., linearly translate) the translatable portion within the inner cavity and move a moving electrical contact within the inner cavity. Venting may be provided after a certain percentage of the stroke is achieved.

While the invention is susceptible to various modifications and alternative forms, specific embodiments and methods thereof have been shown by way of example in the drawings and are described in detail herein. It should be understood, however, that it is not intended to limit the invention to the particular apparatus, systems or methods disclosed, but, to the contrary, the intention is to cover all modifications, equivalents and alternatives falling within the scope of the invention.

What is claimed is:

1. A circuit breaker, comprising:

a circuit breaker housing; and a circuit breaker electrical contact assembly within the circuit breaker housing having an arc chamber housing, the arc chamber housing having an inner cavity, a guide having a translating portion received within the inner cavity and one or more guide supports accessible from outside the inner cavity, the translating portion translatable in the inner cavity, and a drive member coupled to the one or more guide supports.

2. The circuit breaker of claim 1, wherein the drive member comprises a fork having a first end coupled to a first guide support, and a second end coupled to a second guide support.

3. The circuit breaker of claim 1, wherein the guide comprises a first guide support and a second guide support coupled to the translating portion at a first end located outside of the inner cavity.

4. The circuit breaker of claim 3, comprising first and second connector pins coupled to the first guide support and second guide support, respectively.

5. The circuit breaker of claim 1, wherein the first guide support and the second guide support are adapted to slide within grooves formed on an outside surface of the arc chamber housing.

6. The circuit breaker of claim 1, comprising a moving electrical contact assembly coupled to the translating portion.

7. The circuit breaker of claim 6, wherein the moving electrical contact assembly comprises a conductor strap extending along a length of the guide and secured to the guide.

8. The circuit breaker of claim 7, wherein the conductor strap and the translating portion of the guide include a radial gap of less than about 0.4 mm between outer surfaces of the conductor strap and the walls and between the outer surfaces of the translating portion and the walls of the inner cavity to form a semi-sealed arc chamber.

9. The circuit breaker of claim 7, comprising a flexible conductor attached to an end of the conductor strap.

10. The circuit breaker of claim 1, comprising a region of relatively larger cross-sectional area in the inner cavity adapted to provide venting as the guide moves to an opened configuration.

11. The circuit breaker of claim 1, comprising a stationary electrical contact assembly having a stationary electrical contact, the stationary electrical contact positioned within a port at an end of the inner cavity.

12. The circuit breaker of claim 1, wherein the drive member comprises a fork having a first prong coupled to a first guide support, and a second prong coupled to a second guide support.

13. The circuit breaker of claim 12, wherein the fork comprises a bridge portion coupling between the first prong to the second prong, and a spring coupled to the bridge portion.

14. The circuit breaker of claim 12, wherein the fork comprises a first upright and a second upright, and the first upright and second upright are received within pockets formed in a handle of the circuit breaker.

15. The circuit breaker of claim 12, wherein the fork comprises a slot formed on the first prong and a slot formed in the second prong.

16. The circuit breaker of claim 1, wherein the drive member comprises a fork having a first prong with a first slot coupled to a first guide support by a first connector pin, and a second prong with a second slot coupled to a second guide support by a second connector pin.

17. The circuit breaker of claim 1, wherein the translating portion is configured linearly translate within the inner cavity.

18. A circuit breaker electrical contact assembly, comprising:

an arc chamber housing having an inner cavity;

a guide having a translating portion positioned within the inner cavity and one or more guide supports accessible from outside the inner cavity, the translating portion translatable within the inner cavity;

a moving electrical contact assembly coupled to the guide; and a drive member coupled to the one or more guide supports.

19. The circuit breaker contact assembly of claim 18, wherein the moving electrical contact assembly comprises a moving electrical contact secured to a conductor strap extending along a length of the translating portion.

20. The circuit breaker contact assembly of claim 18, comprising a flexible conductor attached to an end of the conductor strap.

21. The circuit breaker contact assembly of claim 18, comprising a stationary electrical contact assembly having a stationary electrical contact, the stationary electrical contact positioned in a port at an end of the inner cavity.

22. A method of operating a circuit breaker, comprising:

providing an arc chamber housing having an inner cavity, a guide having a translating portion positioned within the inner cavity and one or more guide supports outside the inner cavity, and a moving electrical contact assembly coupled to the translating portion;

coupling a drive member to the one or more guide supports; and moving the drive member to translate the translatable portion within the inner cavity and move a moving electrical contact within the inner cavity.

* * * * *